US008294628B2

(12) United States Patent
Le Naour et al.

(10) Patent No.: US 8,294,628 B2
(45) Date of Patent: Oct. 23, 2012

(54) DUAL-BAND ANTENNA FRONT-END SYSTEM

(75) Inventors: Jean-Yves Le Naour, Pace (FR); Ali Louzir, Rennes (FR); Philippe Minard, Saint Medard sur Ille (FR); Jean-Luc Robert, Betton (FR); Francoise Le Bolzer, Rennes (FR)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 12/085,711

(22) PCT Filed: Nov. 28, 2006

(86) PCT No.: PCT/EP2006/069011

§ 371 (c)(1), (2), (4) Date: May 28, 2008

(87) PCT Pub. No.: WO2007/063066

PCT Pub. Date: Jun. 7, 2007

(65) Prior Publication Data

US 2009/0153425 A1 Jun. 18, 2009

(30) Foreign Application Priority Data

Nov. 30, 2005 (FR) ..... 05 12148
Jan. 27, 2006 (FR) ..... 06 50299

(51) Int. Cl.
*H01Q 13/10* (2006.01)

(52) U.S. Cl. ..... 343/770; 343/767

(58) Field of Classification Search ..... 343/770, 343/767

See application file for complete search history.

(56) References Cited

U.S. PATENT DOCUMENTS

| | | | | |
|---|---|---|---|---|
| 6,002,370 | A * | 12/1999 | Mckinnon et al. | 343/700 MS |
| 6,061,024 | A * | 5/2000 | McGirr et al. | 343/700 MS |
| 6,657,600 | B2 * | 12/2003 | Thudor et al. | 343/770 |
| 6,999,038 | B2 * | 2/2006 | Louzir et al. | 343/770 |
| 7,057,568 | B2 * | 6/2006 | Louzir et al. | 343/767 |
| 7,408,518 | B2 * | 8/2008 | Minard et al. | 343/770 |
| 2002/0190905 | A1 | 12/2002 | Flint et al. | |
| 2004/0004571 | A1 | 1/2004 | Adachi et al. | |
| 2004/0113841 | A1 | 6/2004 | Louzir et al. | |
| 2005/0083239 | A1 | 4/2005 | Thudor et al. | |

FOREIGN PATENT DOCUMENTS

| | | |
|---|---|---|
| EP | 1267446 | 12/2002 |
| EP | 1494316 | 1/2005 |
| FR | 2821503 | 8/2002 |
| FR | 2861222 | 4/2005 |

OTHER PUBLICATIONS

Search Report Dated Mar. 5, 2007.

* cited by examiner

*Primary Examiner* — Jacob Y Choi
*Assistant Examiner* — Kyana R McCain
(74) *Attorney, Agent, or Firm* — Tutunjian & Bitetto, P.C.

(57) ABSTRACT

The present invention relates to a multiple-port dual-band antenna system and the associated interface formed by DPDT or SPDT switches, that can be integrated on one and the same multi-layer structure.

3 Claims, 3 Drawing Sheets

DUAL-BAND ANTENNA FRONT-END SYSTEM

Figure 1A:
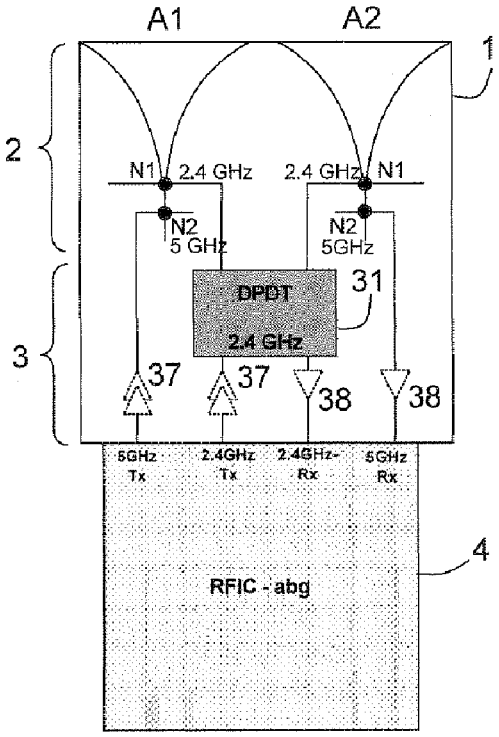

This application claims the benefit, under 35 U.S.C. §365 of International Application PCT/EP2006/069011, filed Nov. 28, 2006, which was published in accordance with PCT Article 21(2) on Jun. 7, 2007 in English and which claims the benefit of French patent application No. 0512148, filed Nov. 30, 2005 and French patent application No. 0650299, filed Jan. 27, 2006.

The invention relates to a system formed by several dual-ported dual-band antennas and interfaces for receiving and transmitting electromagnetic signals. It also relates to any signal processing device provided with such a system.

These days, wireless modems can be used to set up a link between a base station and a terminal equipped with a wireless card. Most of the products on the market conform to the IEEE802.11b standard operating in the 2.4 GHz band. This standard allows for bit rates of up to 11 Mbps.

For higher bit rates, possibly theoretically as high as 54 Mbps, the products need to conform to the IEEE802.11g standard and to the IEEE802.11a standard operating in the 5 GHz band.

Some products operate simultaneously according to the b and g standards. Others according to the a standard. Ultimately, for reasons of compatibility with existing products and in order to use the maximum available capacity, most base stations will be compatible concurrently with all three standards, namely IEEE802.11a, b and g, and therefore need to be able to operate at the 2.4 GHz and 5 GHz frequencies.

Document U.S. Pat. No. 6,246,377 describes a signal transceiver in a 2.4-5 GHz band. Two Vivaldi-type broadband antennas are used separately, one for receiving and the other for transmitting, so avoiding the use of an RX/TX switch. However, this system does not provide antenna diversity.

In order to improve the robustness and the range of the wireless link, it is advantageous to be able to have at least 2nd order antenna diversity. The diversity solutions that can be actually considered require the receive subsystems to be duplicated.

At this time, there is no solution for a system with antenna diversity meeting the requirements of the various standards and not requiring duplication of the receive subsystems.

The invention therefore proposes a dual-band antenna system and associated interface for transmission and reception with wideband antenna diversity according to the different standards, IEEE802.11a, b and g.

The invention proposes a dual-band antenna system with diversity for transmitting and receiving electromagnetic signals comprising at least two antennas and interface means linking the antennas with a signal processing circuit. Each antenna has two separate ports, each port corresponding to a reception and/or a transmission in a determined frequency band, and said interface means can be used to select and transmit signals in the determined frequency band.

Preferably, the system comprises two dual-band antennas with two separate ports and the interface means comprises at least one switching means in at least one of the two frequency bands, so ensuring diversity of reception and transmission of the signals in this band. This switching means is preferably a DPDT (Dual Port Double Throw) switch.

According to a variant of the invention, the antenna system comprises three dual-band antennas with two separate ports and the interface means comprises switching means associated with the receive ports in the two bands, so ensuring diversity of reception in these bands.

Preferably, the switching means are SPDT (Single Port Double Throw) switches.

In an embodiment, the antennas enabling reception with diversity for two separate bands are combined on the side of the ground plane of the multi-layer structure opposite to the layer supporting the power supply lines and switches of the receive circuits whereas the third antenna enabling transmission is implemented on the other side of the ground plane opposite to the layer supporting the power supply lines and switches of the transmit circuits, whereas, in another embodiment, the antennas enabling reception with diversity for two separate bands and the third antenna enabling transmission are combined on one side of the ground plane of the multi-layer structure.

According to a variant of the invention, the interface means comprise amplifiers for amplifying the signals transmitted/received towards the signal processing circuit.

Preferably, the antennas are Vivaldi-type slot antennas powered by electromagnetic coupling and the reception and transmission of the signals are compatible with a standard affiliated to the standard IEEE802.11a, b or g.

The invention also relates to a signal processing device which comprises such an antenna system.

Figure 2A:
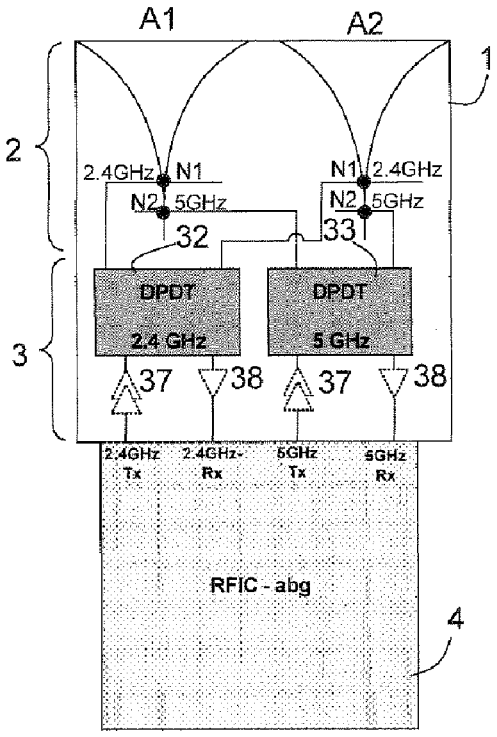
Figure 1B:
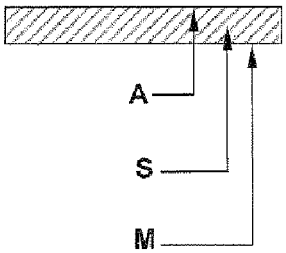
Figure 2B:
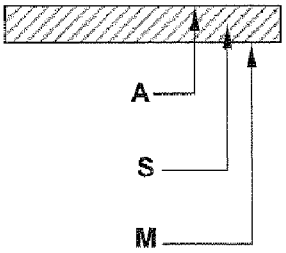
Figure 3A:
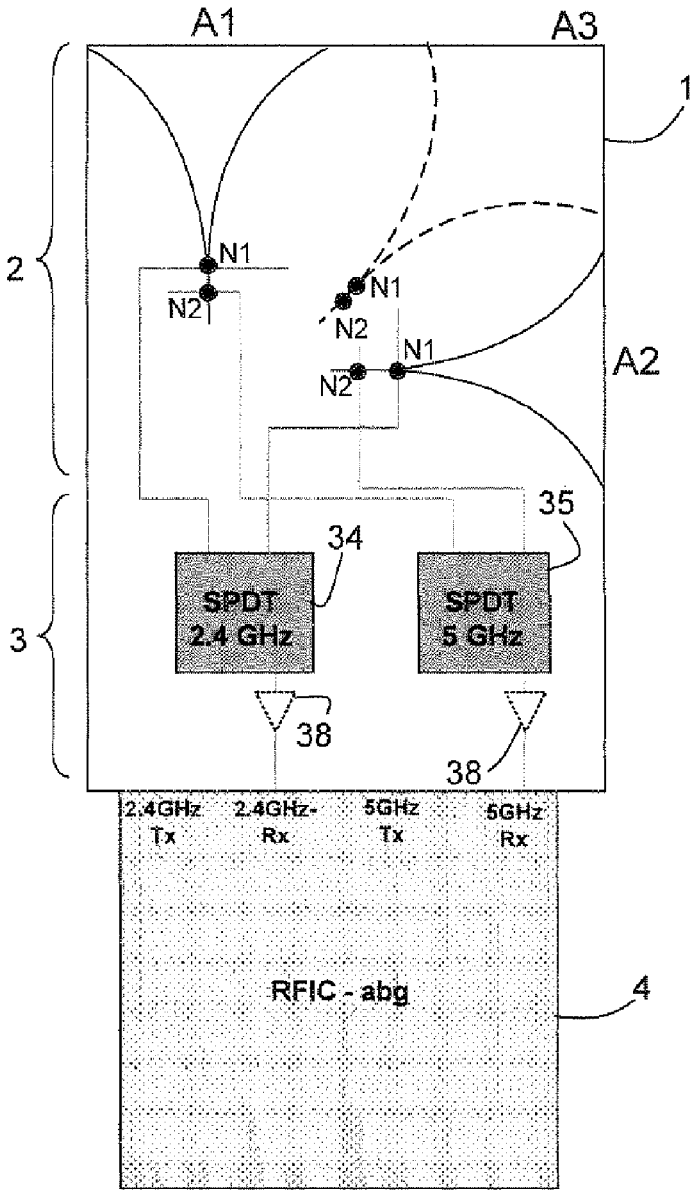
Figure 3C:
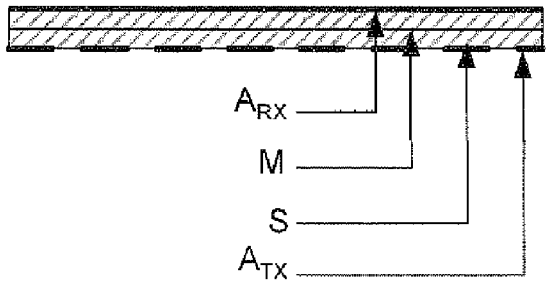
Figure 3B:
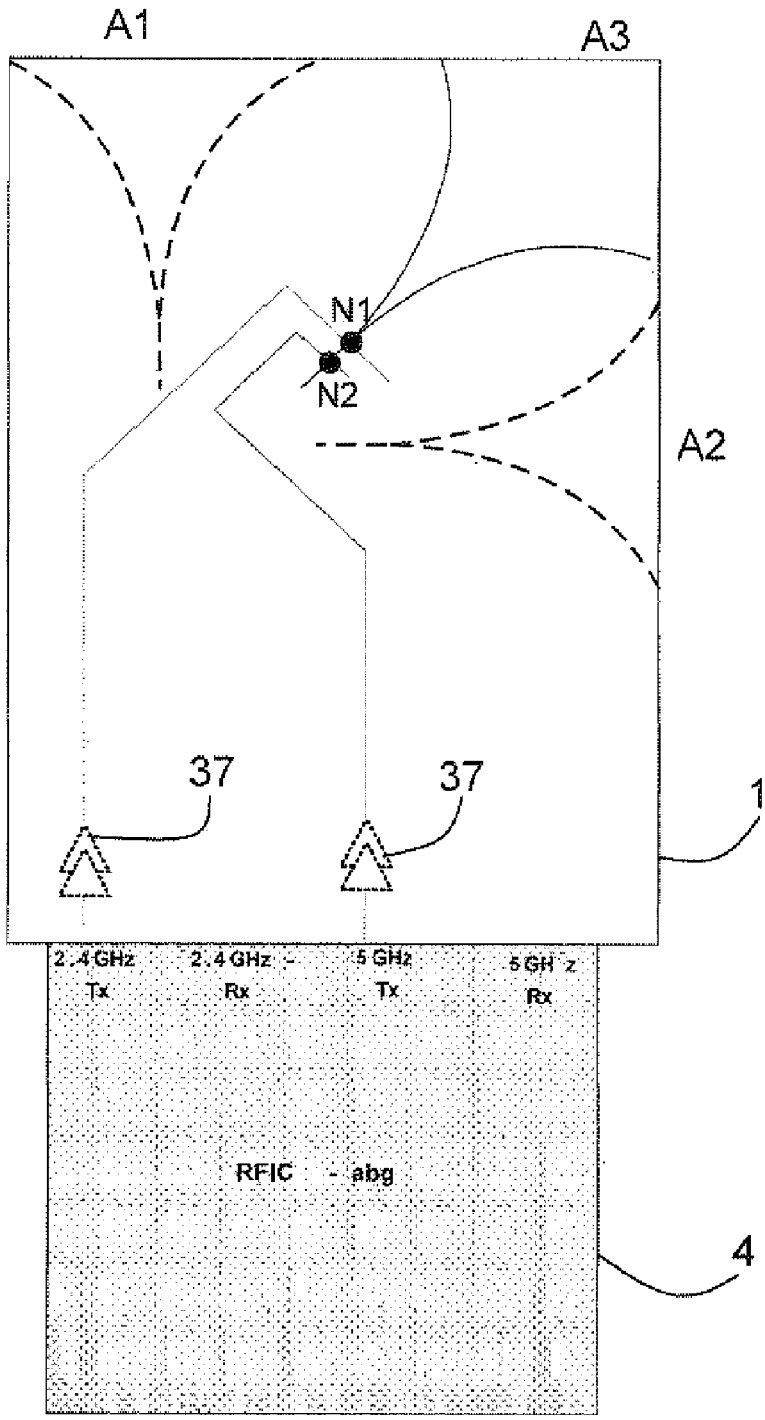

The abovementioned characteristics and advantages of the invention, and others, will become more clearly apparent from reading the description that follows, given in relation to the appended drawings, in which:

FIG. 1*a* represents a first configuration of the system according to the invention and FIG. 1*b* represents a cross-sectional view of the substrate supporting the antennas according to this first configuration;

FIG. 2*a* represents a second configuration of the system according to the invention and FIG. 2*b* represents a cross-sectional view of the substrate supporting the antennas according to this second configuration;

FIGS. 3*a* and 3*b* represent a third configuration of the system according to the invention, FIG. 3*a* representing the receive side view (Rx) and FIG. 3*b* representing the transmit side view (Tx), and FIG. 3*c* representing a cross-sectional view of the multi-layer substrate supporting the antennas according to the third configuration.

To simplify the description, the same references will be used in the above figures to denote elements that fulfill the same functions.

In the three particular configurations, the antenna front-end system 1 according to the invention is made up of an antenna part 2 and another so-called interface (or front end) part 3, and is located upstream of the RFIC (Radio Frequency Integrated Circuit) circuit 4 of the signal receive/transmit subsystem. This front-end system 1 has four input/output terminals for the connection with the RFIC circuit, respectively corresponding to the receive Rx and transmit Tx ports at the 2.4 GHz frequency and receive Rx and transmit Tx ports at the 5 GHz frequency.

The system 1, according to the first embodiment represented by FIG. 1*a*, comprises two wideband or dual-band antennas A1 and A2 covering all the bands at 2.4 GHz and 5 GHz allocated by the a, b and g standards allowing a simple reception at the 5 GHz frequency and a reception with 2nd order antenna diversity only at the 2.4 GHz frequency. This pair of slot antennas with longitudinal radiation, for example of Vivaldi type, A1 and A2, with separate dual ports N1 and N2 for the 2.4 GHz and 5 GHz frequencies, allows for signals to be received and transmitted in these frequency bands. The port N1 of the antenna A1 and the port N1 of the antenna A2 are linked via an interface 31 to the 2.4 GHz Tx and 2.4 GHz Rx terminals of the RFIC. This interface 31 is, for example, a dual-input, dual-output switching circuit of narrowband DPDT type in the 2.4 GHz band. It manages the switching of the signals between the ports N1 at 2.4 GHz of each of the antennas A1, A2 and each of the terminals of the RFIC circuit at 2.4 GHz, corresponding to the transmit Tx or receive Rx port. It therefore manages the selection either of one of the 2.4 GHz receive channels of the antennas (antenna diversity) or of one 2.4 GHz transmit channel of one or other of the antennas. The two other ports N2 at 5 GHz, of the antenna A1 for transmission and of the antenna A2 for reception, are respectively and directly linked to the 5 GHz Tx and Rx ports of the RFIC circuit. This interface solution uses only a single external component, the DPDT switching circuit, that can be incorporated in the structure proposed for the implementation of the antennas which will be explained below. Furthermore, this component operates in low frequency and narrowband mode since it is limited only to the 2.4 GHz band. The intrinsic losses of the component are therefore reduced. FIG. 1*b* represents a cross-sectional view of the substrate supporting the antennas according to this first configuration. The antennas are formed on a substrate S, for example a very inexpensive substrate such as FR4. The ground plane M including the profile of the two antennas is located on the bottom layer of the substrate. The Vivaldi antennas are powered by electromagnetic coupling to a microstip power supply line etched on the opposite side of the substrate. The top layer A is therefore used for the power supply circuits and for the switching interface 31.

Possibly, if necessary, for transmission, power amplifiers 37, external to the RFIC, can be connected to the transmit terminals Tx of the RFIC circuit to amplify the signal to be transmitted. Similarly, if necessary, for reception, low noise amplifiers 38 can be connected to the receive terminals of the RFIC circuit to amplify the received signal.

FIG. 2*a* represents a second configuration of the system according to the invention for which antenna diversity is required at 2.4 GHz and also at 5 GHz. A pair of Vivaldi-type slot antennas A1 and A2 with two separate ports N1 and N2 at 2.4 GHz and at 5 GHz respectively makes it possible to receive signals in these frequency bands. The ports N1 at 2.4 GHz and the ports N2 at 5 GHz of the antennas A1 and A2 are multiple ports. They are used for the transmission and reception of data and are linked to coupling circuits 32 and 33 forming the interface part with the RFIC circuit.

This circuit 32 is, for example, a narrowband DPDT switch circuit in the 2.4 GHz band. It can be used to switch each of the antennas A1, A2 to each of the inputs corresponding to the Tx or Rx port. It therefore manages the selection at 2.4 GHz either of one of the receive channels of the antennas (antenna diversity) or of one transmit channel of one or other of the antennas.

Similarly, the circuit 33 is, for example, a narrowband DPDT switch circuit in the 5 GHz band. It can be used to switch each of the antennas A1 and A2 to each of the inputs corresponding to the Tx or Rx port of the RFIC circuit 4. It therefore manages the selection at 5 GHz either of one of the receive channels of the antennas (antenna diversity) or of one transmit channel of one or other of the antennas.

This solution uses two external components, that can be incorporated in the structure proposed for the implementation of the antennas in a manner described by FIG. 2*b*, identical to FIG. 2*a*.

Possibly, if necessary, for transmission, power amplifiers 37, external to the RFIC, can be connected to the transmit terminals Tx of the RFIC circuit to amplify the signal to be transmitted. Similarly, for reception, low-noise amplifiers 38 can be connected to the receive terminals of the RFIC circuit to amplify the received signal.

FIG. 2*b* represents a cross-sectional view of the substrate supporting the antennas according to this second configuration in a way similar to that of the first configuration. The top layer A is used to implement the power supply circuits and the two switching interfaces 32 and 33.

FIGS. 3 represent a third configuration of the system according to the invention for which antenna diversity is required at 2.4 GHz and at 5 GHz. This third configuration is characterized by the implementation on the multi-layer structure, described by FIG. 3*c*, of three antennas. One pair of Vivaldi-type slot antennas A1 and A2 with two separate ports N1 and N2 at 2.4 GHz and at 5 GHz allowing only the reception of signals in these frequency bands, are implemented on one side of the structure. An interface 34 makes it possible to select the received signal from the two signals received at the 2.4 GHz frequency. Similarly, an interface 35 makes it possible to select the received signal from the two signals received at the 5 GHz frequency. A switch, such as, for example, an SPDT (Single Port Dual Throw) circuit, represents an adequate switch. The interface enabling the reception of the signals at 2.4 GHz and at 5 GHz, formed by two SPDT circuits 34 and 35, is therefore minimized because there is no longer a need to couple the transmit—receive ports to a certain frequency. These circuits can be incorporated on one side of the multi-layer structure as represented by FIG. 3*c*.

A third Vivaldi-type slot antenna, intended for the transmission of signals in the 2.4 GHz and 5 GHz bands, is placed on the other side of the substrate (FIG. 3*c*). The input terminals Tx of the signal to be transmitted are directly linked to the different ports of this antenna. In transmit mode, a direct coupling between the RFIC element of the transmit subsystem and the antennas makes it possible to eliminate the losses that were due to the presence of a DPDT circuit.

It is possible to implement the Vivaldi antennas in a manner as represented in FIG. 3*c*. The two Vivaldi antennas for data reception with diversity in the 2.4 and 5 GHz bands are etched on the top side of the ground plane M, on two edges at 90° of a conventional FR4-type multi-layer PCB supporting the motherboard. The third antenna is etched on the bottom side, in the corner of the FR4-type multi-layer structure. The Vivaldi antennas are powered by electromagnetic coupling to a microstip power supply line etched on the opposite sides of the substrate. The power supply circuits for transmission $A_{TX}$ are located on the bottom side and the power supply circuits for reception $A_{RX}$ are located on the top side of the multi-layer structure of the substrate. This structure with three Vivaldi antennas, etched on the sides of the common ground plane, also makes it possible to provide a better insulation between the power supply circuits for transmission and the power supply circuits for reception.

Other layouts making it possible to separate the transmission and the reception of the data and consequently to simplify the associated interface, can be envisaged.

Possibly, if necessary, low-noise amplifiers 38 for reception and power amplifiers 37 for transmission can be connected to the terminals of the RFIC circuit as described previously.

In another embodiment, the three Vivaldi antennas are positioned on one and the same side of the ground plane.

The invention claimed is:

1. A dual band antenna system comprising three dual band antennas, realized on a multilayer structure, each antenna having two separate ports for transmitting and receiving signals in two determined frequency bands and interface means linking the signals to a signal processing circuit wherein the interface means comprises switching means for switching the two received signals in each of the two frequency bands to a signal processing circuit so as to ensure diversity of reception of the signals in each frequency band, wherein the antennas enabling reception with diversity and the switching means are realized on a surface corresponding to a first side of a ground plane of the multilayer structure, and enabling transmission of the signals in said two determined frequency bands is the third antenna implemented on the opposite surface corresponding to a second side of the ground plane of said multilayer structure and directly linked to said signal processing circuit.

2. The dual band antenna system of claim 1, wherein the switching means are SP{DT switches.

3. The dual band antenna system of claim 1, wherein the reception and transmission of the signals are compatible with a standard affiliated to the standard IEEE802.11a, b or g.

* * * * *